US009934881B2

(12) United States Patent
Niu et al.

(10) Patent No.: US 9,934,881 B2
(45) Date of Patent: Apr. 3, 2018

(54) NON-METALLIC LIGHT CONDUCTIVE WIRE AND ITS METHOD AND APPLICATION PRODUCTS

(71) Applicant: XI'AN JIAOTONG UNIVERSITY, Xi'an, Shanxi (CN)

(72) Inventors: Chunming Niu, Shanxi (CN); Chong Xie, Shanxi (CN); Yonghong Cheng, Shanxi (CN)

(73) Assignee: XI'AN JIAOTONG UNIVERSITY, Xi'an, Shanxi (CN)

( * ) Notice: Subject to any disclaimer, the term of this patent is extended or adjusted under 35 U.S.C. 154(b) by 69 days.

(21) Appl. No.: 14/570,782

(22) Filed: Dec. 15, 2014

(65) Prior Publication Data

US 2015/0348668 A1 Dec. 3, 2015

(30) Foreign Application Priority Data

Feb. 11, 2015 (CN) ..... 2014 1 0241033

(51) Int. Cl.

| | |
|---|---|
| ***H01B 1/12*** | (2006.01) |
| ***H01B 3/30*** | (2006.01) |
| ***H01B 7/17*** | (2006.01) |
| ***H01B 13/06*** | (2006.01) |
| ***H01B 13/08*** | (2006.01) |
| ***H01B 3/44*** | (2006.01) |
| ***H01B 1/04*** | (2006.01) |
| *H01B 7/00* | (2006.01) |

(52) U.S. Cl.

CPC ..... *H01B 1/12* (2013.01); *H01B 1/04* (2013.01); *H01B 3/30* (2013.01); *H01B 3/306* (2013.01); *H01B 3/441* (2013.01); *H01B 7/17* (2013.01); *H01B 13/062* (2013.01); *H01B 13/08* (2013.01); *H01B 7/0009* (2013.01); *Y10T 29/49119* (2015.01)

(58) Field of Classification Search

USPC ..... 174/70 R

See application file for complete search history.

(56) References Cited

U.S. PATENT DOCUMENTS

| | | | | |
|---|---|---|---|---|
| 7,413,474 | B2 * | 8/2008 | Liu | H01B 11/1808 439/579 |
| 7,769,251 | B2 * | 8/2010 | Varkey | E21B 47/06 385/100 |
| 2011/0174519 | A1 * | 7/2011 | Shah | H05K 9/009 174/119 C |
| 2015/0307321 | A1 * | 10/2015 | Breite | D07B 1/02 187/254 |

* cited by examiner

*Primary Examiner* — William H Mayo, III
*Assistant Examiner* — Krystal Robinson

(57) ABSTRACT

The present invention relates to a non-metallic light conductive wire, a composite conductive wire, a special cable, a motor and the like application products made of the conductive wire, and a method of making the composite conductive wire.

8 Claims, 1 Drawing Sheet

NON-METALLIC LIGHT CONDUCTIVE WIRE AND ITS METHOD AND APPLICATION PRODUCTS

FIELD OF THE INVENTION

The invention belongs to the electrical field, especially involving a non-metallic light conductive wire, a method and its application products.

BACKGROUND OF THE INVENTION

At present, three methods are mainly used for synthesis of carbon nanotube fiber: wet spinning, carbon nanotube array direct spinning method and floating chemical vapor deposition drawing method. The pure double-wall carbon nanotube fiber made by Rice University [NatnaelBehabtu et al. Strong, Light, Multifunctional Fibers of Carbon Nanotubes with Ultrahigh Conductivity. Science 339, 182 (2013)] of USA with the wet spinning method shows excellent mechanical properties and electrical properties. However, it is difficult to use the wet spinning method widely since the cost of the method is too high (market price: USD 2,000/g). After copper doping, the conductivity of the carbon nanotube fiber, which is made by Hata research group [Chandramouli Subramaniam et al. One hundred fold increase in current carrying capacity in a carbon nanotube-copper composite. DOI: 10.1038/ncomms3202.] of Japan with the carbon nanotube array direct spinning method, can approach to that of copper, and its carrier density is about 100 times of that of copper. As the large scale of grown carbon nanotube array is limited by the size of silicon substrate, the array spinning method is unsuitable for industrialized production. A plurality of carbon nanotube fibers with a length of several kilometers, which is made by Tianjin University [Xiao Hua Zhong et al. Continuous Multilayered Carbon Nanotube Yarns. Adv. Mater. 2010, 22, 692-696] with the floating chemical vapor deposition drawing method, show good mechanical properties. However, the electrical properties of the carbon nanotube fiber synthesized with this method are poor mainly due to the synthesis process of making carbon nanotube with floating vapor deposition method at the current stage. At present, the number of walls of carbon nanotube synthesized with this method is uneven, and the carbon nanotube contains a plurality of carbon impurities and catalyst particles as it is drawn directly without purification, thus influencing the electrical properties and mechanical properties of the carbon nanotube fiber.

SUMMARY OF THE INVENTION

For the defects existing in the current technology, the invention discloses a non-metallic light conductive wire including a bundle of branch conductor wires and an insulating protective layer. The branch conductor wires forms the inner conductor, which is wrapped by the insulating protective layer. The branch conductor wire includes a high strength polymer fiber core and a carbon nanotube conductive layer wrapped on the core.

Optionally, a plurality of branch conductor wires twisted with each other to form the inner conductor.

In addition, the invention also discloses a composite conductive wire, the composite conductive wire is made of one or a plurality of the conductive wires.

In addition, the invention also discloses a special cable, the special cable is made of one or a plurality of the conductive wires.

In addition, the invention also discloses a method of making the composite conductive wire, the method comprises following steps of:

S100: letting outside of a plurality of high strength polymer fiber cores (1.1) be wrapped by a double-wall carbon nanotube layer (1.2);

S200: letting the plurality of cores (1.1) wrapped with double-wall carbon nanotube layer (1.2) be twisted to wind together for making an inner conductor; and

S300: letting outside of the inner conductor be wrapped by an insulating protective layer (2).

Optionally, the Step S300 includes: The surface of inner conductor is wrapped with a layer of polyimide as the insulating protective layer (2) via ultrasonic spraying or by pulling the inner conductor through polyimide solution.

Optionally, it is a continuous process from the Step S100 to S300, wherein, the carbon nanotube is extruded onto the surface of the core with the coaxial extrusion method in the Step S100, and the insulating protective layer is extruded onto the surface of inner conductor with the coaxial extrusion method in the Step S300.

Compared with the existing technologies, the above technical solution has the following advantages:

The carbon nanotube is directly wrapped on the surfaces of high strength polymer fiber core in the invention. The operation is simple and is easy for large scale of industrialized production. With this method, the surfaces of conductors made are even, and a plurality of polyether ether ketone fibers are further twisted to wind together, thus the structure is more compact, and both the electrical properties and the mechanical properties can be improved further. Replacement of the copper conductor with the above conductive wire can largely decrease the weight of corresponding equipment, e.g. the motor.

DETAILED DESCRIPTION OF THE PREFERRED EMBODIMENTS

The invention is further described below based on the diagrams. It should be understood that these embodiments are merely intended to illustrate the invention and are not intended to limit the scope of the invention. It should also be understood that after reading the content taught in the invention, the technician in this field can make various modifications of the invention, or modifications of these equivalent forms also fall within the present application as defined by the appended claims scope.

In an embodiment, the invention discloses a non-metallic light conductive wire including a bundle of branch conductor wires and an insulating protective layer. The bundle of branch conductor wire forms an inner conductor, which is wrapped by the insulating protective layer. The branch conductor wire includes the high strength polymer fiber core and the carbon nanotube conductive layer wrapped on the core.

The embodiment means the conductive wire includes the central carrier of high strength polymer fiber core, the conductive layer represented by the conductor in high conductivity carbon nanotube on the surface of carrier, and the insulating protective layer wrapped on the inner conductor. Compared with metals, the high strength polymer fiber has smaller density and higher strength, and the carbon nanotube has smaller density and good conductivity. As the structure of carbon nanotube is the same as the lamellar structure of graphite, the carbon nanotube has very good electrical properties. The high strength polymer fiber as core can not only reduce the weight of conductor, but also ensure good mechanical strength of the conductor. Due to the absence of metallic conductive wire but the good conductivity, the non-metallic light weight conductive wire can be used for manufacturing the other corresponding products of light weight conductive wire, e.g. cables, motors and the like.

Optionally, a plurality of branch conductor wires (1) twisted with each other to form the inner conductor.

Figure 1:
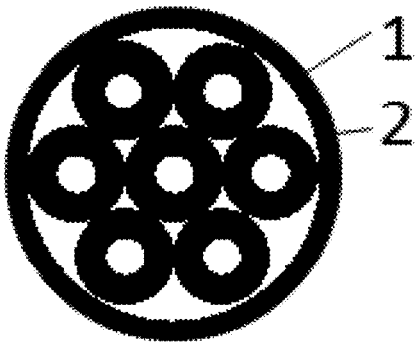
FIG. 1 and FIG. 2 are the structural schematic diagrams of branch conductor in an embodiment of the invention.
Figure 2:
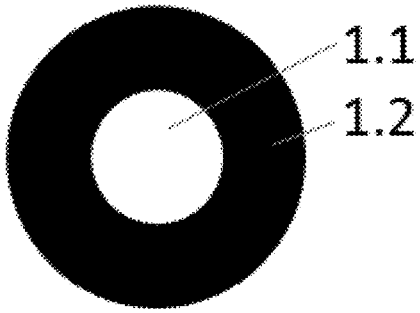

Refer to FIG. 1 and FIG. 2, the composite cables of the invention include a plurality of branch conductor wires (1), which are twisted to form the inner conductor of a cable, the inner conductor is also wrapped by the insulating protective layer (2). The inner conductor is packaged by the insulating protective layer (2). The branch conductor wire (1) includes the core (1.1) and the carbon nanotube layer (1.2) wrapped on the core (1.1), which is made of high strength polymer fiber. In the invention, the surface of the core (1.1) is directly wrapped by a carbon nanotube layer (1.2). Due to the good adsorption force between the carbon nanotube and the fiber, the carbon nanotube layer (1.2) can tightly be absorbed on the core (1.1). After a plurality of branch conductors are twisted together, the structure is more compact, and both the electrical properties and the mechanical properties can be further improved.

Preferably, the insulating protective layer is made of plastics.

More preferably, when the conductive wire is used to make plain conductors, the insulating protective layer (2) includes a single polymer insulating layer, which is made of any of the materials of polyimide (PI), polyamideimide (PAI) and crosslinked polyethylene (XLPE); and when the conductive wire is used to make special cables, the insulating protective layer is a multilayered structure, which includes a conductor shielding layer, an insulating layer, an insulating shielding layer and an external protective layer.

More preferably, in another embodiment, the core (1.1) is made of any of the materials of polyether ether ketone (PEEK) fiber, polyimide (PI) fiber, polyamide (PA) fiber, polyamideimide (PAI) fiber and ultra high molecular weight polyethylene (UHMPE) fiber, and the diameter of the core is 0.01 mm to 2 mm.

In another embodiment, the carbon nanotube conductive layer (1.2) includes a single-wall carbon nanotube, a double-wall carbon nanotube, a multi-wall carbon nanotube or a hybrid carbon nanotube, and the thickness of the conductive layer is 0.01 times to twice of the diameter of the core.

In another embodiment, the invention also discloses a composite conductive wire, which is made of one or a plurality of the conductive wires.

In another embodiment, the invention also discloses a special cable, which is made of one or a plurality of the conductive wires.

In another embodiment, the invention also discloses a motor, which is characterized in that the winding in the motor is made of the conductive wire. The composite conductive wire, the special cable and the motor above explained above illustrates the related products and the field of the conductive wire in the invention.

In addition, the composite conductive wire of the invention is made through the following steps:

S100: letting outside of a plurality of high strength polymer fiber cores (1.1) be wrapped by a double-wall carbon nanotube layer (1.2);

S200: letting the plurality of cores (1.1) wrapped with double-wall carbon nanotube layer (1.2) by twisted to wind together for making an inner conductor; and

S300: letting outside of the inner conductor be wrapped by an insulating protective layer (2).

Optionally, the Step S300 includes: The surface of inner conductor is wrapped with a layer of polyimide as the insulating protective layer (2) via ultrasonic spraying or by pulling the inner conductor through polyimide solution.

Optionally, it is a continuous process from the Step S100 to S300, wherein, the carbon nanotube is extruded onto the surface of the core with the coaxial extrusion method in the Step S100, and the insulating protective layer is extruded onto the surface of inner conductor with the coaxial extrusion method in the Step S300.

During the solidification process of polyimide solution, the volume of polyimide solution shrinks, thus exerting a pressure on the carbon nanotube fiber wrapped by it, making the plurality of carbon nanotube fibers contact more tightly, and improving the conductivity of fibers. Meanwhile, as polyimide has excellent mechanical properties and relatively high melting point, the application field of the conductor becomes wider, e.g. the conductor made of carbon nanotube can be used to make the winding of motor, thus largely reducing the weight of motor.

Optionally, in order to wrap the double-wall carbon nanotube on the polyether ether ketone fiber core, the plurality of polyether ether ketone fiber core can be pulled through the double-wall nanotube solution prepared in advance slowly at a uniform velocity. After the polyether ether ketone fiber passing through the double-wall nanotube solution, the surface of each fiber is wrapped by a layer of double-wall carbon nanotube. The thickness of carbon nanotube layer on polyether ether ketone fiber surface can be controlled via the pulling speed and the concentration of carbon nanotube solution. Each polyether ether ketone fiber is separated from the other during absorption of carbon nanotube.

Exemplarily, the Step S100 includes:

S101: using ethanol, carbon monoxide or methane as the carbon source for synthesis of double-wall carbon nanotube in the manner of chemical vapor deposition, then purificating through vapor oxidation and liquid acid pickling to obtain a double-wall carbon nanotube;

S102: dispersing the double-wall carbon nanotube in a liquid for making a carbon nanotube dispersion liquid;

S103: pulling a plurality of cores, which do not contact with each other, through the carbon nanotube dispersion liquid to form double-wall carbon nanotube coating on surfaces of the cores, thus obtaining a plurality of cores wrapped with the double-wall carbon nanotube layer; and

S104: letting post treatment be made for the coated cores wrapped with the double-wall carbon nanotube layer, the post treatment including heating, drying, solvent cleaning, reheating, redrying, and repetition of S102 and S103, till the coating thickness of carbon nanotube to reach a required thickness, then, letting a plurality of the cores be twisted to wind together for making the inner conductor.

More preferably, a plurality of polyether ether ketone fibers wrapped with double-wall carbon nanotube is directly collected on a concentrator after being twisted. The conductor made of a plurality of polyether ether ketone fibers can form a plurality of conductive channel. After twisting, the double-wall carbon nanotube on each strand of polyether ether ketone fiber can contact more tightly, thus reducing the conductivity of conductor.

The invention adopts high strength polymer fiber as the carrier, of which, the surface is wrapped by a layer of double-wall carbon nanotube, to prepare the conductor with high conductivity, and the preparation process is simple and suitable for large scale production. The conductor has not only good conductivity, but also small density and light weight.

While the invention is described in detail, herein a case of application of the specific principles of the invention, and the above description of the embodiment are used to aid in understanding the invention and the core idea. Meanwhile, according to the idea in the invention, ordinary technician in the field will make changes both in the specific embodiments and application scope. In summary, the present specification shall not be construed as limiting the invention.

What is claimed is:

1. A non-metallic light weight conductive wire, comprising a bundle of non-metallic light conductive branch conductor wires (1) and an insulating protective layer (2), the bundle of non-metallic light conductive branch conductor wires (1) forming an inner conductor, which is wrapped by the insulating protective layer (2), wherein the non-metallic light conductive branch conductor wire (1) includes a high strength polymer fiber core (1.1) and a carbon nanotube conductive layer (1.2) wrapped on the core; wherein a plurality of non-metallic light conductive branch conductor wires (1), which twisted mutually to form the inner conductor, wherein the diameter of the core is 0.01 mm to 2 mm and wherein the thickness of the conductive layer is 0.01 times to twice of the diameter of the core.

2. The conductive wire described in claim 1, wherein when the conductive wire is used to make plain conductors, the insulating protective layer (1) includes a single polymer insulating layer, which is made of anyone of the materials of polyimide (PI), polyamideimide (PAI) and crosslinked polyethylene (XLPE); and when the conductive wire is used to make special cables, the insulating protective layer is a multilayered structure, which includes a conductor shielding layer, an insulating layer, an insulating shielding layer and an external protective layer.

3. The conductive wire described in claim 1, wherein the core (1.1) is made of any high strength fibers, including but not limited to polyether ether ketone (PEEK) fiber, polyimide (PI) fiber, polyamide (PA) fiber, polyamideimide (PAI) fiber and ultra high molecular weight polyethylene (UHMPE) fiber, and that the diameter of the core is 0.01 mm to less than 1 mm.

4. The conductive wire described in claim 1, wherein the carbon nanotube conductive layer (1.2) includes a single-wall carbon nanotube, a double-wall carbon nanotube, a multi-wall carbon nanotube or a hybrid carbon nanotube, and that the thickness of the conductive layer is 1.1 times to twice of the diameter of the core.

5. A composite conductive wire comprising one or a plurality of the conductive wires of claim 1.

6. A special cable comprising one or a plurality of the conductive wires of claim 1.

7. A composite conductive wire comprising two or more of the conductive wires of claim 1.

8. A special cable comprising, the special cable being made of two or more of the conductive wires of claim 1.

* * * * *